United States Patent [19]

Pierrot

[11] 4,045,632

[45] Aug. 30, 1977

[54] QUICK MAKE AND BREAK SWITCH

[75] Inventor: Henri Pierrot, L'Isle d'Espagnac, France

[73] Assignee: La Telemecanique Electrique, France

[21] Appl. No.: 642,529

[22] Filed: Dec. 19, 1975

[30] Foreign Application Priority Data

Apr. 14, 1975 France ..... 75.11490

[51] Int. Cl.[2] ..... H01H 13/36

[52] U.S. Cl. ..... 200/67 PK; 200/67 D

[58] Field of Search ..... 200/67 D, 67 PK

[56] References Cited

U.S. PATENT DOCUMENTS

| | | | |
|---|---|---|---|
| 2,486,033 | 10/1949 | Kaminky | 200/67 D |
| 2,870,282 | 1/1959 | Brand | 200/67 PK |
| 3,501,606 | 3/1970 | Harper | 200/67 D |

*Primary Examiner*—David Smith, Jr.

*Attorney, Agent, or Firm*—William Anthony Drucker

[57] ABSTRACT

The invention relates to a quick make and break switch, particularly to measures which permit the positive opening of the normally closed contacts if the contacts in question are welded, and then to utilize the measures taken to make possible the opening of contacts even in the case where the elastic element necessary for rapid opening is fractured.

According to the invention, this is achieved in that the rocking lever has a second arm whose second end arranged opposite the first end is located in the vicinity of the movable contact and is supported beneath the inverter member in the form of a rigid bracket if the latter has not switched under the action of the elastic blade at the time when alignment is performed and in that the lever pivot is located substantially equidistantly from the push-button of the second end.

3 Claims, 2 Drawing Figures

QUICK MAKE AND BREAK SWITCH

BACKGROUND OF THE INVENTION

The present invention relates to a quick make and break switch comprising in a box two fixed contacts and one movable contact placed at the end of an inventer member whose central portion has an opening and having at one end a pivot cooperating with a fixed support and an edge, opposite to the pivot which is subject to the action of a curved elastic blade applied by compression between the said edge, and a movable support placed at the end of the first arm of a rocking lever subject to the action of a push-button whose movement makes it possible to align the said movable support with the pivot and the said edge.

A switch of this type is known, for example, from British Pat. No. 833,336.

Moreover, from Soviet Pat. No. 128,208 a switch of the above type is known wherein the inverter member is constructed in the form of a U-shaped bracket, in the central area of which is provided a longitudinal opening through which are placed fixed and movable members respectively acting as the fixed and movable supports.

A disadvantage common to both these devices is that if the movable contact is welded to the fixed contact, against which it is applied in the inoperative state, the operation of the push-button does not lead to the development of a sufficiently large rocking force to break this weld which can impair equipment whose operating reliability is based on the opening of the said contact.

Moreover, if the elastic blades used in these switches fracture the action exerted on the push-button is no longer transmitted to the inverter member and the equipment associated with the circuit controlled by the switch is subject to the same danger as mentioned hereinbefore.

BRIEF SUMMARY OF THE INVENTION

The invention therefore proposes to obviate the disadvantages inherent in the prior art and to take measures firstly permitting the positive opening of the normally closed contact if the contacts in question are welded, and then to utilise the first mesures taken to make possible the opening of contacts even in the case where the elastic element necessary for rapid opening is fractured.

According to the invention, this is achieved in that the rocking lever has a second arm whose second end arranged opposite the first end is located in the vicinity of the movable contact and is supported beneath the inverter member in the form of a rigid bracket if the latter has not switched under the action of the elastic blade at the time when alignment is performed and in that the lever pivot is located substantially equidistantly from the push-button of the second end.

Studies of the kinematics of the switching system as well as that relative to the mechanical stresses withstood by the various members in the system, taking account of the small volumes laid down by the appropriate Standards for equipment of this type, have shown that the measures taken hereinbefore are ideal for solving the set problem.

BRIEF DESCRIPTION OF THE DRAWINGS

Other and further objects of the present invention will be apparent from the following description and claims and are illustrated in the accompanying drawings which by way of illustration show preferred embodiments of the present invention and the principles thereof and what are now considered to be the best modes contemplated for applying these principles. Other embodiments of the invention embodying the same or equivalent principles may be used and structural changes may be made as desired by those skilled in the art without departing from the present invention and the scope of the appended claims. In the drawings show:

DETAILED DESCRIPTION OF THE PREFERRED EMBODIMENTS

Figure 1:
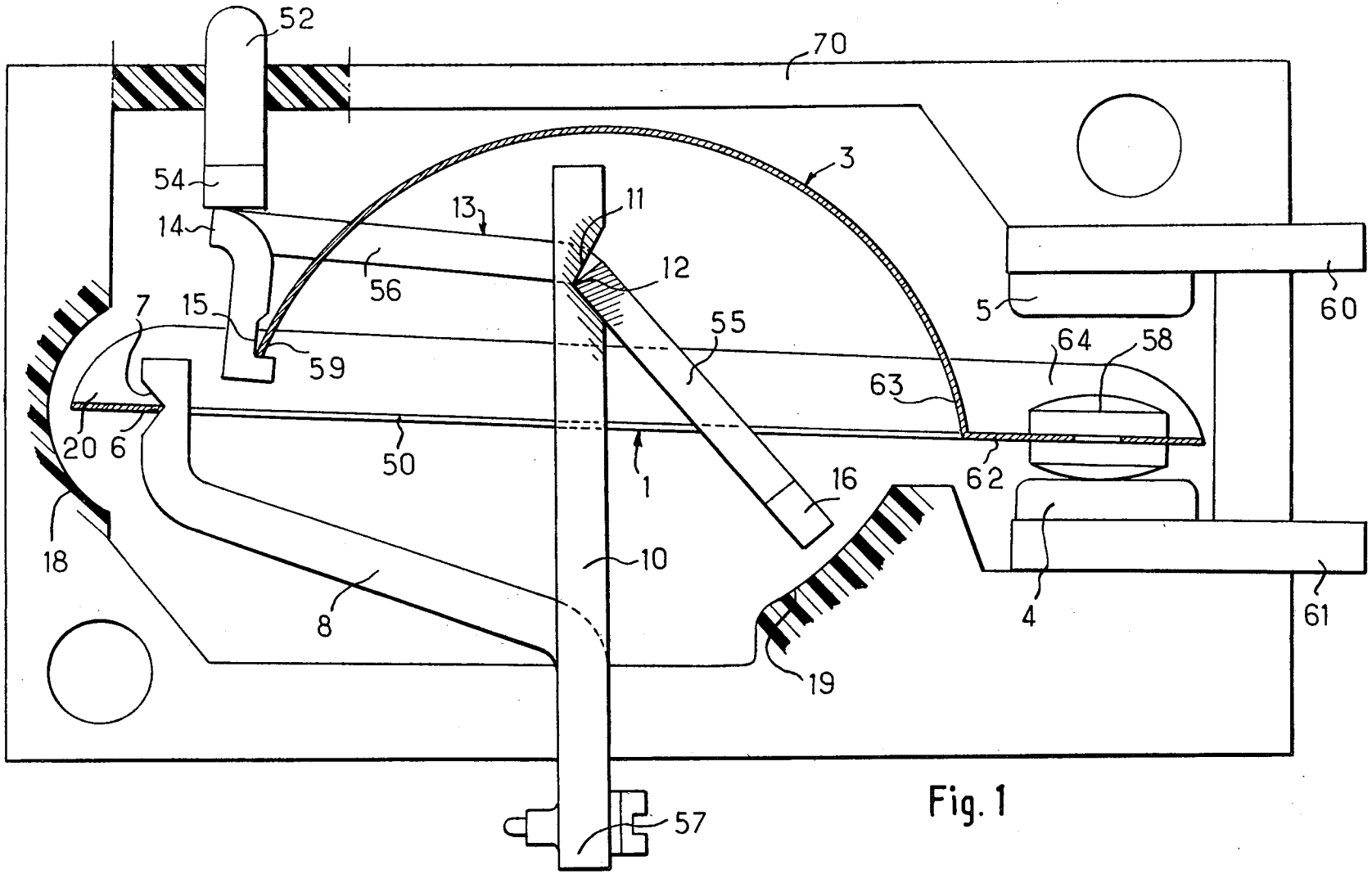
FIG. 1, a side view of a first embodiment of the invention with the equipment box open.

Referring firstly to FIG. 1, the switch body 70 made from moulded insulating material receives three fixed members, namely the two fixed contacts 4 and 5 of the inverter in each case extended by a metal terminal 61 or 60, and a third terminal 57 which is extended within the box by two branches 8 and 10 each having a slot 7 or 11.

With the said fixed members cooperate three movable members and one elastically deformable member, namely:

An inverter member 1 pivoted on branch 8 and carrying at one of its ends 64 a double movable contact 58 which can be applied to one or other of the fixed contacts 4, 5.

A rocking lever 13 pivoted to branch 10 and having two arms 55, 56 placed on either side of pivot 11, 12.

A push-button 52 slidingly mounted in the box and positioned facing end 14 of the first arm 56, and finally a curved elastic blade 3 which is supported by longitudinal compression on the first arm and on an area of the inverter member adjacent to end 64.

The construction of the various support and pivot points was brought about in the following manner:

The inverter member 1 in the form of a thin sheet metal bracket having a U-shaped cross-section is perforated in its median area by an elongated opening 50, whereof a first edge 6 adjacent to end 20 engages in a slot 7 of arm 8 to constitute a first support. The second edge of opening 50 opposite to the first and therefore adjacent to end 64 of the inverter member receives the first end 63 of the elastic blade 3. In the embodiment of FIG. 1, blade 3 is formed by the metal portion from the opening which has remained integral with the inverter member; however, the operating characteristics are not changed if this blade 3 comprises an independent member suitably supported on the second edge of the opening. The second end 59 of the said blade is supported in slot 15 made at end 14 of the first arm 56 of rocking lever 13 which also has an edge 12 which engages in a slot 11 of the second branch 10 to constitute the pivot of the said lever. This second branch is positioned in such a way that it traverses opening 50 in an area which is substantially equidistant relative to ends 20, 64 of the inverter member.

Figure 2:
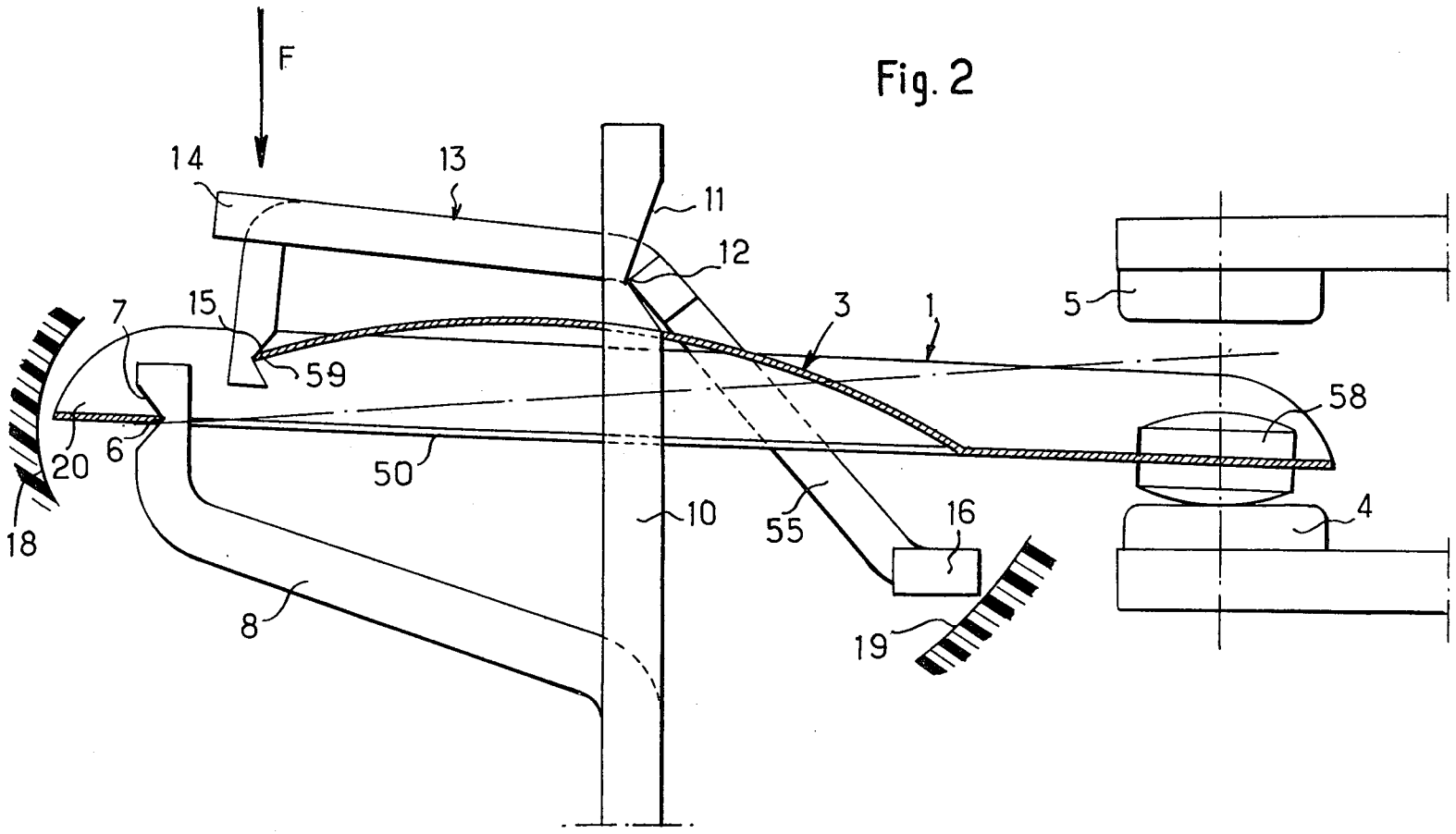
FIG. 2, another side view of a second embodiment with the box open.

In the embodiments of FIGS. 1 and 2, it can be seen that the first arm 56 and the pivot 11, 12 are positioned above the inverter member, whilst the second arm 55 of the lever is extended so that its second end 16 is located beneath the inverter member and adjacent to the movable contact 58. In FIG. 1 the elastic blade 3 passes above pivot 11, 12 and the second arm 55 traverses opening 50, whilst in the embodiment of FIG. 2 the elastic blade 3 passes beneath pivot 11, 12 and the second arm 55 does not traverse opening 50 but is located at the side of the inverter member, whereby end 16 is still located beneath the inverter member in an area adjacent to the end.

The operation of such a switch which is intended to bring about a quick make and break of the contacts is well known. When the push-button causes the rotation of rocking lever 13 the second point of support 15 of the elastic blade becomes aligned with the first fixed support 7 of the inverter member and the second edge 62 of opening 50 of the inverter member whilst causing a supplementary compression of the elastic blade 3 which restores part of its energy to the inverter member by causing it to switch over as soon as the second point of support has passed beyond the said alignment.

However, when arks or overcurrents occur between contacts 4 and 58 there can be a small weld between these two contacts preventing the separation thereof.

The position of end 16 of the rocking lever is selected in such a way that in this contingency a contact between the latter and the lower portion of the inverter member is immediately caused to act on passng beyond the alignment in such a way that a direct mechanical stress (i.e. not involving an elastic member) is formed between push-button 52 and contact 58 to bring about the fracture of the weld.

This optimum result is obtained on the one hand through the shape of the inverter member whose U-shaped cross-section has been chosen so as to give a large rigidity and on the other due to the fact that the pivot 11, 12 of the rocking lever 13 is positioned substantially equidistantly from the end of the inverter member carrying the movable contact and the end 14 of the first arm of the rocking lever. If the pivot was in fact located closer to end 14, the separating force of the welded contacts would be reduced, whereas if the pivot was placed closer to end 16 the travel of the push-button would have to be greater to bring about a separation of the contacts which would impair the precision of the moment of opening and could endanger the installations controlled by the electric circuit to be opened.

Moreover, the central position of the branch 10 relative to the ends of the inverter member, and therefore of pivot 11, 12 makes it possible to give the elastic blade a considerable length leading to a smaller distortion of the manufacturing dimensions and an improvement of the mechanical stresses.

The pivoting method chosen for the rocking lever 13 leads to an additional improvement to the operating reliability if the walls of box 70 are given contours which prevent the disconnection of lever 13 from pivot 11, 12 if the elastic blade 3 fractures.

Referring now to FIG. 1, it can be seen that the second end 16 in its rotation movement is displaced adjacent to a protective surface 19 formed by a portion of the inner surface of the wall. This surface has a curvature whose centre is adjacent to that of the pivot 11, 12 in such a way that if the above-mentioned contingency occurs the rocking lever continues to be guided in rotation and can ensure its emergency function which is that of raising the inverter member 1.

The latter can in turn form the object of an analogous safety measure if adjacent to its end 20 where the pivot formed by surfaces 6 and 7 is located a second protective surface 18 analogous to the first is provided carried by the wall of the box, or any other solid, and whose centre of curvature is adjacent to that of the pivot in question. With a reduced clearance a planar surface portion brings about a comparable effect.

In the embodiment of FIG. 2 the elastic blade 3 assumes a less curved configuration and is located between the inverter member 1 and the pivot 11, 12.

This arrangement makes it necessary for branch 10 and the second arm 55 to each have an opening, or the second arm 55 of the lever must pass to the outside of opening 50.

The invention is not limited to the embodiments described and represented hereinbefore, various modifications being possible thereto without passing beyond the scope of the invention. Thus, for example, the rocking lever can be disposed in the place of branch 8 and support 15, 19 is fixed, whereby push-button 52 then acts on end 20 of the inverter member.

What is claimed is:

1. A quick make and break switch comprising, enclosed in a box: two fixed contacts and a movable contact; a fork-shaped support member having first and second branches located in a common plane and a lug connected to the said branches and forming a terminal for the movable contact; an inverter member carrying the movable contact and shaped as a comparatively rigid bracket having first and second ends and a longitudinal opening, said opening having first and second transverse edges, the first transverse edge being swivellingly supported at the end of said second branch remote from said lug; a rocking lever located in the said common plane, swivellingly supported on the end of the first branch remote from said lug and having on either side of the said first branch first and second arms respectively having first and second ends remote from the first branch; a push-button cooperating with the first end of the arms and placed above the first end of the inverter member whilst the second end of the arms is placed below the second end of the inverter member; a curved elastic blade having first and second ends respectively compressed between the first end of the arms and the second transverse edge of the opening, said elastic blade having a snap-on action on the inverter member for a predetermined position of the first end of said elastic blade, the second arm of the rocking lever being dimensioned and positioned, with respect to the inverter member end, for allowing mechanical engagement between the said second arm and the inverter member, after the first end of the elastic blade has passed beyond the said predetermined position.

2. A switch according to claim 1, wherein the first and second branches of the support member traverse said opening, the first branch being positioned at substantially equal distance from the respective ends of the inverter member, and having at its end remote from the lug a first slot cooperating with a pivoting edge of the rocking lever, wherein the first transverse edge of the said inverter member cooperates with a second slot formed at the end of the second branch remote from the lug and wherein the curved elastic blade passes above said pivoting edge.

3. A switch according to claim 2, wherein the box has a wall internally provided with first and second curved guiding surfaces respectively adjacent to the first end of the inverter member and the second end of the arms, said surfaces having centres of curvature which are respectively located adjacent to the said second slot and to the pivoting edge of the rocking lever, the first guiding surface being adapted to cooperate with the first end of the inverter member and the second guiding surface being adapted to cooperate with the second end of the arms.

* * * * *